US008921294B2

(12) United States Patent
Matharu

(10) Patent No.: US 8,921,294 B2
(45) Date of Patent: Dec. 30, 2014

(54) CLEANING LIQUID

(75) Inventor: Navjeet Kaur Matharu, Torfaen (GB)

(73) Assignee: Ronald Alexander (Scot) Young, West Midlands (GB)

( * ) Notice: Subject to any disclaimer, the term of this patent is extended or adjusted under 35 U.S.C. 154(b) by 387 days.

(21) Appl. No.: 13/329,039

(22) Filed: Dec. 16, 2011

(65) Prior Publication Data

US 2012/0172451 A1 Jul. 5, 2012

(30) Foreign Application Priority Data

Dec. 17, 2010 (GB) ..... 1021452.6

(51) Int. Cl.

| | |
|---|---|
| ***C11D 3/48*** | (2006.01) |
| ***C11D 1/66*** | (2006.01) |
| ***C11D 3/20*** | (2006.01) |
| ***C11D 3/36*** | (2006.01) |
| *C11D 1/62* | (2006.01) |

(52) U.S. Cl.

CPC .. *C11D 3/48* (2013.01); *C11D 1/62* (2013.01); *C11D 1/66* (2013.01); *C11D 3/2086* (2013.01); *C11D 3/362* (2013.01)

USPC ..... 510/131; 510/161; 510/384; 510/504

(58) Field of Classification Search

CPC ..... C11D 1/62; C11D 3/48; C11D 3/2086; A01N 33/12; A01N 59/00

USPC ..... 510/161, 504, 384, 131

See application file for complete search history.

(56) References Cited

U.S. PATENT DOCUMENTS

| | | | | |
|---|---|---|---|---|
| 6,908,962 | B1 * | 6/2005 | Frankenbach et al. | 524/588 |
| 7,569,530 | B1 | 8/2009 | Pan et al. | |
| 8,318,231 | B2 * | 11/2012 | Warf et al. | 426/534 |
| 2003/0100465 | A1 * | 5/2003 | Kilkenny et al. | 510/384 |
| 2004/0170822 | A1 * | 9/2004 | Rohrbaugh et al. | 428/323 |
| 2005/0118130 | A1 * | 6/2005 | Utz et al. | 424/70.13 |
| 2005/0129643 | A1 * | 6/2005 | Lepilleur et al. | 424/70.1 |
| 2005/0159324 | A1 * | 7/2005 | Man et al. | 510/218 |
| 2006/0115440 | A1 * | 6/2006 | Arata et al. | 424/65 |
| 2008/0015134 | A1 * | 1/2008 | Ahmed et al. | 510/234 |
| 2009/0148342 | A1 * | 6/2009 | Bromberg et al. | 422/37 |
| 2010/0279906 | A1 * | 11/2010 | Schwarz et al. | 510/111 |
| 2010/0286270 | A1 * | 11/2010 | Foret et al. | 514/558 |
| 2011/0177148 | A1 * | 7/2011 | Dicosimo et al. | 424/411 |

FOREIGN PATENT DOCUMENTS

| | | | |
|---|---|---|---|
| GB | 2407581 | A | 5/2005 |
| WO | 2007/051965 | A1 | 5/2007 |

* cited by examiner

*Primary Examiner* — Gregory Webb

(74) *Attorney, Agent, or Firm* — Kilpatrick Townsend & Stockton LLP

(57) ABSTRACT

The present invention relates to a cleaning fluid, in particular a cleaning fluid for cleaning surfaces.

22 Claims, 4 Drawing Sheets

CLEANING LIQUID

CROSS-REFERENCE TO RELATED APPLICATIONS

The present application claims priority to GB1021452.6 filed Dec. 17, 2010, the teaching of which is hereby incorporated hereby by reference in its entirety for all purposes.

DESCRIPTION OF INVENTION

The present invention relates to a cleaning liquid. More particularly, the present invention relates to a cleaning liquid for cleaning surfaces. The present invention also relates to a method of forming a cleaning liquid.

Surfaces often come into contact with, provide an environment for and provide a breeding ground for, potentially harmful pathogens. Non-limiting examples of surfaces include floors, table tops, and kitchen side boards, having any angle relative to ground level and of any shape, i.e. reference to surfaces is not limited to flat surfaces. A potentially harmful pathogen is any organism which can cause disease. Non-limiting examples of potentially harmful pathogens include bacteria, fungi, viruses, moulds and yeasts.

It is common to clean surfaces with agents which act to mitigate and/or destroy potentially harmful pathogens. The cleaning of surfaces in this way is beneficial to human and animal health, so as to prevent the spread of disease and mitigate the chances of a subject or subjects contracting a disease by coming into contact with potentially harmful pathogens.

One environment where it is particularly beneficial to clean surfaces with agents which act to mitigate and/or destroy potentially harmful pathogens is in hospitals. At the present time, there are often reports of persons contracting potentially harmful diseases in hospitals when they have gone to hospital for routine operations and/or procedures. There has been particularly visible media coverage in the UK of persons contracting, inter alia, *Clostridium difficile* and Methicillin Resistant *Staphylococcus Aureus* (MRSA) whilst in hospital. The UK National Health Service (NHS) website states that, "Cleanliness in hospitals is important in minimising the spread of infection."

Surfaces in hospitals should be cleaned regularly to prevent the build up of potentially harmful pathogens. Cleaning liquids used to clean surfaces include bleach solutions, solutions of washing up liquid, alcohol based disinfectants and general disinfectant liquid. One non-limiting example of a disinfectant liquid is Dettol®, as currently sold in the UK by Reckitt Benckiser®.

Another known surface cleaner is Scrunge®, as sold by Scot Young Research Ltd., and its associated companies. Scrunge® was disclosed in UK published patent application number GB0614875.3 (published as GB2431863). Scrunge® acts as a degreasing and a flocculating chemical additive to enhance the break up of secondary floor films created in conjunction with soil particles and insoluble materials, such as fat and oil.

Scrunge®, which is a degreasing flocculating chemical additive comprises, and typically consists of, water at 23.466% w/w, citric acid at 20% w/w, isothiazolinones at 0.02% w/w, kenapan green liquid at 0.003% w/w, C9-C11-Pareth-8 at 22.5% w/w, butyl glycol at 10% w/w, alkylpoly glucoside 50% at 20% w/w, and cationic ethoxylated propoxylated acrylic monopolymer at 4% w/w.

Isothiazolinones act as a preservative; C9-C11-Pareth-8 and alkylpoly glucoside 50% act as surfactants; butyl glycol is a solvent; and cationic ethoxylated propoxylated acrylic monopolymer is the flocculating agent.

The ratios of the ingredients in Scrunge® can be altered, to the same effect. Preferably, the cationic ethoxylated propoxylated acrylic monopolymer flocculating agent is in a range of 2% to 8% w/w. C9-C11-Pareth-8 is in a range of 15% to 25% w/w; and the alkylpoly glucoside 50% is in a range of 15% to 25% w/w. The Scrunge® formulation has a pH of 2.5 to 4.5; this pH is maintained by an acidic buffer, namely citric acid.

In using a cleaning liquid, containing Scrunge®, cleaning liquid is transferred from a mop bucket or other container to a dirty surface. The dirty surface to be treated is typically a greasy floor of a kitchen or restaurant. Using the mop or other cleaning implement, the surfactants lift the insoluble, typically grease, fat and/or oil, particulate matter by the sorption of water and surfactant, soil penetration and primary emulsification with the aid of abrasive movement of the mop or cleaning implement. The particulate matter agglomerates and the insoluble matter emulsifies into a micro-emulsion that is picked up more readily by the mop material or cleaning implement.

The mop or cleaning implement transfers the agglomerated and emulsified matter to the mop bucket. Through rinsing, the agglomerated and emulsified matter flocculates due to the action of the cationic ethoxylated propoxylated acrylic monopolymer, resulting in agglomerated and emulsified matter which sinks. The insoluble flocculated agglomerated and emulsified matter can be collected in a grid at the base of the mop bucket, where it gathers as a suspension and/or sediment at and/or adjacent to the bottom surface of the mop bucket.

An additional benefit of Scrunge® is that, as the initially flocculated matter sinks, it collects more particulate and insoluble matter suspended in the cleaning liquid moving it also to the base of the mop bucket.

The Scrunge® formulation is effective at degreasing greasy surfaces and flocculating any matter in a receptacle containing dirty water so that the flocculated matter sinks and does not disperse throughout the water. In other words, Scrunge® is particularly useful in the cleaning and degreasing of greasy surfaces, e.g. in restaurants, kitchens and canteens. However, the Scrunge® formulation does not have a particularly powerful anti-pathogen activity.

In cleaning surfaces, in particular in cleaning surfaces in hospitals, it is preferable for the anti-pathogen agent to be active in the presence of organic matter for a number of minutes, for example, up to 1, 2, 3, 4, 5, 10, 15, 20, 25, 30, 35, 40, 45, 50, 55, 60, 70, 80 and 90 minutes, and all other times in between. It is particularly preferable for the anti-pathogen agent to be active for at least 60 minutes in a hospital environment so that a cleaner may continue to use a cleaning solution containing a cleaning liquid for a suitable amount of time, without having to repeatedly replenish the cleaning solution, for example because the activity of the anti-pathogen agent has decreased.

Known floor cleaning formulations do have anti-pathogen activity. One example disinfectant sold for use in cleaning hospital surfaces is DIFICIL-S®, as sold in the UK by Clinimax Ltd. DIFICIL-S® utilises chlorine dioxide (which can be harmful to humans and animals) as its active anti-pathogen agent. Published test results indicate that DIFICIL-S® is successful in mitigating a number of pathogens. However, DIFICIL-S® does not have a flocculating action and the use of chlorine dioxide as the anti-pathogen agent means that the anti-pathogen activity reduces quickly, within 5-10 minutes of introducing organic matter (for example by way of a mop). Thus, to maintain the anti-pathogen activity of DIFICIL-S®, a user must regularly replenish their cleaning formulation.

DIFICIL-S® has a relatively short shelf life, around ten days before degrading, due to its use of chlorine dioxide.

Other known disinfectants include bleach solutions, which are effective at destroying pathogens on surfaces. However, bleach does not have a flocculating effect; bleach can also be harmful to humans and animals in its own right. Solutions of washing up liquid have relatively weak anti-pathogen activity, as well as no flocculation activity. Alcohol based disinfectants have no flocculating ability and the alcohol, which has anti-pathogen activity, is relatively volatile so it evaporates off and has a relatively short anti-pathogen activity time.

It is preferable for cleaning liquids, specifically those used in a hospital environment, to have a relatively long (around 1 hour) anti-pathogen activity time so that after, for example, a floor has been mopped the anti-pathogen activity continues for long enough that pathogens do not have a chance to settle and/or grow in between cleaning cycles. Disinfectant liquid, e.g. Dettol®, is effective in its anti-pathogen activity, but many pathogens build up resistance to long-used disinfectants, and they lack flocculating activity.

There is currently no multi-purpose cleaning liquid which provides a relatively long anti-pathogen activity (around 1 hour) and flocculating activity, along with no harmful side affects on humans and animals.

As will be appreciated, there is a need for a new cleaning liquid which can be applied to surfaces and which provides a relatively long anti-pathogen activity (around 1 hour) and flocculating activity, along with no harmful side affects on humans and animals.

In a first aspect of the present invention, there is provided a cleaning liquid comprising:

a surfactant, a flocculant, an anti-pathogenic agent, and an acid, wherein, the acid maintains the cleaning liquid at a pH of 0.5 to 1.2 at 20° C.

Preferably, wherein the acid is a mixture of acids.

Further preferably, wherein the acid is a mixture of citric acid and phosphoric acid.

Advantageously, wherein the mixture comprises 10-20% w/w of monohydrate citric acid and 4-8.5% w/w of phosphoric acid.

Preferably, wherein the surfactant is non-ionic surfactant C9-C11-Pareth-8 and/or alkyl polyglucoside.

Further preferably, wherein the mixture comprises 12-16% w/w of non-ionic surfactant C9-C11-Pareth-8 and 5-10% w/w of alkyl polyglucoside.

Advantageously, wherein the flocculant is Ethanium, N,N,N-trimethyl-2-(2-methyl-1-oxo-2-propenyl)chloride, polymer with 2-propenamide and/or paraffin oil.

Preferably, wherein the mixture comprises 0.9-2.0% w/w of Ethanium, N,N,N-trimethyl-2-(2-methyl-1-oxo-2-propenyl)chloride, polymer with 2-propenamide and 0.25-0.75% w/w of paraffin oil.

Further preferably, wherein the anti-pathogenic agent is an anti-bacterial, an anti-fungal, an anti-mould, an anti-yeast and/or an anti-viral agent.

Advantageously, wherein the anti-pathogenic agent is 2-bromo-2-nitro-1,3-propanediol, glutaral, poly (hexamethylenebiguanidine)hydrochloride and/or di-n-decyl dimethylammonium chloride.

Preferably, wherein the cleaning liquid comprises 0.45-1.5% w/w of 2-bromo-2-nitro-1,3-propanediol, 0.1-1.0% w/w of glutaral, 0.8-5.0% w/w of poly (hexamethylenebiguanidine)hydrochloride and 5.0-9.5% w/w of di-n-decyl dimethylammonium chloride Further preferably, wherein the cleaning liquid further comprises a solubiliser, preferably, alkyl polyglycol ether C12-15 with EO.

Advantageously, wherein the cleaning liquid comprises 0.1-0.6% w/w of alkyl polyglycol ether C12-15 with EO.

Preferably, wherein the cleaning liquid further comprises a chelating agent, preferably, disodium EDTA.

Further preferably, wherein the cleaning liquid comprises 0.05-0.20% w/w of disodium EDTA.

Advantageously, the cleaning liquid further comprising a preservative, preferably, isothiazolinones mixture.

Preferably, wherein the cleaning liquid comprises 0.02-0.10% w/w of isothiazolinones mixture.

Further preferably, the cleaning liquid further comprising a fragrance, preferably, Floral Bouquet 245567.

Advantageously, the cleaning liquid further comprising a colourant, preferably, Acid Red 14 Conc 160% and/or Acid Blue 9/33% 42090.

Preferably, the cleaning liquid further comprising a solvent, preferably, butyl glycol and/or propan-2-ol.

In a further aspect, the present invention provides an aqueous mixture comprising: water and a cleaning liquid according to the above.

Preferably, wherein the water is tap water, potable water, dirty water, water containing soil, water containing effluent, water containing pathogens, water containing waste, waste water and/or brackish water.

Further preferably, wherein the formulation has a ratio of water to cleaning liquid of from 99% water to 1% cleaning liquid to 1% water to 99% cleaning liquid.

Advantageously, wherein the formulation has a ratio of water to cleaning liquid of 99%, 95%, 90%, 85%, 80%, 75%, 70%, 65%, 60%, 55%, 50%, 45%, 40%, 35%, 30%, 25%, 20%, 15%, 10%, 5%, 4%, 3%, 2%, 1.5%, 1%, 0.9%, 0.8%, 0.7%, 0.6%, 0.5%, 0.4%, 0.3%, 0.2%, 0.1% or 0.05% water to cleaning liquid.

Preferably, wherein the formulation has a ratio of water to cleaning liquid of from 99% water to 1% cleaning liquid.

The present invention also provides a method of cleaning a surface, comprising:

providing a cleaning liquid or an aqueous mixture according to the above; and, applying the mixture to a surface.

The present invention further provides a method of preparing a cleaning liquid according to the above, comprising:

providing the ingredients according to the above; and, mixing the ingredients in a mixer.

In a further aspect of the present invention, there is provided a cleaning liquid with the formulation of any one of formulations A, B or C disclosed in Table 1, or A1, A2, B1, B2, C1, C2 or D in Table 2.

Some of the components of the cleaning liquids of the present invention, together with their sources, are set out below.

Surfactant

The term surfactant is an abbreviated form of surface active agent. A surfactant is a substance, or mixture of substances, which has the effect of altering the interfacial tension of water and other liquids of solids, for example a detergent or soap. A surfactant is used in the formulations of the present invention to reduce the interfacial tension between oil and water, and/or dirt/soil and water. Exemplary surfactants used in the present invention include non-ionic surfactant C9-C11-Pareth-8 (CAS No. 68439-45-2) and alkyl poly glucoside (CAS No. 68515-73-1). Other suitable surfactants include: alkyl glucosides, alcohol ethoxylate with 6.5EO (EO represents a number of oxyethylene groups between carbon chains of a non-ionic surfactant), alkyl polyglycol ether ethoxylate ether ethoxylate, alcohols, C12-15 ethoxylated polyglycols, cocaminopropyl betaine, cocamidodiethanolamide, polyethylene glycol-5 lauryl citrate, phosphoric acid alkyl polyglycol ester, imidazolines based on surfactants (zwitterion based) and/or mixtures thereof.

Flocculant

A flocculant is a substance, or mixture of substances, which promotes the clumping of particles. Flocculants are particularly used in the treatment of waste water, to form floccules of waste which can more easily be filtered, centrifuged and/or skimmed off of waste water, than if the waste particles were evenly dispersed throughout the waste water. Exemplary flocculants used in the present invention include Ethanium, N,N,N-trimethyl-2-(2-methyl-1-oxo-2-propenyl) chloride, polymer with 2-propenamide (CAS No. 35429-19-7) and/or paraffin oil (CAS No. 8042-47-5). Other suitable flocculants include any agent which promotes the clumping of particles.

Anti-Pathogenic Agent

Anti-pathogenic agents include any agent which acts to mitigate and/or destroy potentially harmful pathogens. Potentially harmful pathogens include any organism which can cause disease. Non-limiting examples of potentially harmful pathogens include bacteria, fungi, viruses, moulds and yeasts. Exemplary anti-pathogenic agents used in the present invention include 2-bromo-2-nitro-1,3-propanediol (anti-bacterial, anti-fungal, anti-mould and anti-yeast; CAS No. 52-51-7), glutaral (anti-bacterial and anti-fungal; CAS No. 111-30-8), poly (hexamethylenebiguanidine)hydrochloride (anti-bacterial, anti-fungal, anti-mould and anti-yeast; CAS No. 27083-27-8) and/or di-n-decyl dimethylammonium chloride (anti-bacterial, anti-fungal, anti-mould and anti-yeast; CAS No. 7173-51-5). Other suitable anti-pathogenic agents include: propylene glycol, 5-bromo-5-nitro-1,3-dioxane, n-alkyl dimethyl benzyl ammonium chloride, mixtures of n-(C12-18)-alkyl dimethyl benzyl ammonium chloride and n-(C12-C14)-alkyl dimethyl benzyl ammonium chloride, dipotassium peroxodisulphate, chlorine dioxide, 2,4,4'-trichloro-2'-hydroxydiphenyl ether and/or mixtures thereof.

Acid

In its broadest definition, an acid is any compound which is able to donate a proton or accept electrons in a chemical reaction. A compound is said to be acidic if the compound has a pH less than 7. The acids used in the cleaning liquids of the present invention are relatively strong acids because the acids are used in the cleaning liquids of the present invention to provide cleaning liquids with strongly acidic pHs, i.e. in the range of from 0.5 to 1.2 at 20° C. Exemplary acids used in the cleaning liquids of the present invention include citric acid (pH of 1.8 at 50 g/l at 20° C.; CAS No. 5949-29-1) and/or phosphoric acid (pH of around 1.08 at 1 mol/L at 20° C.; CAS No. 7664-38-2). Other suitable acids for use in formulations of the present invention include: formic acid, acetic acid, maleic acid, lactic acid, and extracts from bilberry composed of alpha-hydroxy acids, sugar cane extracts, maple sugar extracts, alpha-hydroxy acids derived from orange and lemon (certain exemplary extracts producing useful acids, with reference to their INCI listings, include: *Vaccinium myrtillus* (bilberry), *Saccharum officinarum* (sugarcane) extract, *Acer saccharinum* (sugar maple) extract, and/or *Citrus aurantium* dulcis (orange) fruit extract (and) *Citrus medica* limonum (lemon) fruit extract).

Without wishing to be bound by theory, it is believed that the combination of a surfactant, a flocculant, an anti-pathogenic agent, and an acid, where the amount of acid is such that the acid maintains the cleaning liquid at a pH of 0.5 to 1.2 at 20° C., provides a cleaning fluid with beneficial properties. The Scrunge® formulation, mentioned above, is less acidic (pH 2.5 to 4.5 at 20° C.). Use of a pH of 0.5 to 1.2 at 20° C. in a cleaning liquid according to the present invention was found to provide a cleaning liquid with beneficial properties. Cleaning liquid according to the present invention was also found to have a relatively long shelf life, i.e. storage for greater than 2 years is anticipated to result in a still stable and functioning formulation, preferably when stored below 30° C.

All measurements of pH and temperature mentioned in this specification were taken on a Hanna Instruments Ltd. device, with the model no. HI98127 (a waterproof pH and ° C./° F. probe). The measurements of pH and temperature could be taken on other generally available pH and temperature probes.

Manufacturing Protocol for the Formulations:

The following is a protocol for forming cleaning liquids according to formulations A, B and C shown in Table 1, and formulations A1, A2, B1, B2, C1, C2 and D in Table 2. The amounts of each ingredient used at each step are shown in Tables 1 and 2, i.e. they are not specified in the methods below. In one exemplary embodiment, all of the ingredients shown in the tables are mixed in any order, in the amounts specified in the tables, to result in a formulation according to the present invention.

In another exemplary embodiment, the formulations of the present invention are prepared as follows:

i. Select a clean manufacturing vessel, e.g. a stainless steel mixing vessel with a propeller shaft.
ii. Ensure any inlets or outlets from the manufacturing vessel are clean.
iii. Measure out all raw materials, as required by the Tables.
iv. Place the weighed raw materials in a safe storage position(s).
v. Meter water into the manufacturing vessel.
vi. Commence stirring at a desired stirring speed, e.g. 108 revolutions per minute.
vii. Add required amount of ethanium, N,N,N-trimethyl-2-(2-methyl-1-oxo-2-propenyl)chloride, polymer with 2-propenamide and paraffin oil with alkyl polyglycol ether C12-15 with EO. Mix for minimum of 30 minutes to a smooth paste.
viii. To the smooth paste prepared in vii. add citric acid and mix until the mixture is translucent in appearance.
ix. To the smooth translucent mixture add a mixture of isothiazolinones, followed by poly (hexamethylenebiguanidine)hydrochloride, with further mixing to maintain a smooth micro-crystalline paste.
x. Whilst mixing, add non-ionic surfactant C9-11-pareth-8 and reduce speed, e.g. to 60 revolutions per minute; at this stage a viscous mixture is maintained.
xi. Mix for 30 minutes to achieve a homogenous mixture.
xii. Add 50% of the butyl glycol to the mixing mixture followed by Alkyl polyglucoside to a homogenous mix.
xiii. Add phosphoric acid.
xiv. The mixture maintains its Newtonian (Newtonian is a consistency of a liquid state with minimal viscosity, similar to water) consistency. Check pH and record. At this interim stage the pH should be around 0.2-0.5 at 20° C.
xv. Adjust the pH if necessary with phosphoric acid before proceeding with the next steps.
xvi. Add the following in the specified order, mixing between additions: 2-bromo-2-nitro-1,3-propanediol, glutaral, di-n-decyl dimethylammonium chloride (50% solution in propan-2-ol).

xvii. Allow further mix for 30 minutes to achieve a clear solution of mixture.

xviii. Add the remaining 50% butyl glycol, slowly add to the mixture and allow for a further 30 minutes. Add disodium EDTA and mix for a further 30 minutes. Continue mixing with addition of fragrance Floral 245567.

xix. Add required amounts of colour(s) initially adding Acid Red W Conc followed by Acid Blue 47335.

xx. Portion the prepared mixture into a suitable container, as desired.

Table 1 details different formulations, A, B and C, according to different embodiments of the present invention. The names of the ingredients are listed, along with their CAS (Chemical Abstract Service) number. The CAS number has been given because the CAS registry is a standard reference for persons looking to classify chemical compounds which are known in the scientific literature. Each formulation has been assigned an identifying alphabetical tag, e.g. the ingredients of formulation A are listed in the column below the heading A. In all of the formulations, the amount of each ingredient is provided in weight % (also referred to in this specification as wt % or % w/w).

All of the formulations discussed below, and included in the tables, share the same ingredients. However, in each of the formulations A, B and C, certain amounts of the ingredients have been changed. Ranges for each of the ingredients in the formulations have been provided. All formulations falling within these boundaries have the same effects. The ranges are provided to show the ranges which have been tested.

Additional embodiments are shown in Table 2. These embodiments show formulations A1, A2, B1, B2, C1, C2 and D which have been prepared and tested.

The formulations of the present invention are in compliance with Regulation (EC) 1907/2006 (REACh). In other words, the ingredients comply with the relevant EC law on safety in chemicals used in domestic environments.

All of the formulations discussed above, and included in the tables, all contain water in a generally pure form, e.g. tap water/potable water. Water is a diluent.

In use, the formulations of the present invention are mixed with water. Preferable mixing ratios with water for all of the exemplary formulations (A, B, C, A1, A2, B1, B2, C1, C2 and D) are, in percentage terms (where 1% means 99 parts tap water to 1 part exemplary formulation) 100%, 95%, 90%, 85%, 80%, 75%, 70%, 65%, 60%, 55%, 50%, 45%, 40%, 35%, 30%, 25%, 20%, 15%, 10%, 5%, 4%, 3%, 2%, 1.5%, 1%, 0.9%, 0.8%, 0.7%, 0.6%, 0.5%, 0.4%, 0.3%, 0.2%, 0.1% and 0.05%. A particularly preferred mixing ratio is 1%.

In use, the cleaning formulations of the present invention are applied to a surface by an applicator, for example, a mop, a sponge, a cloth, a towel or a glove. In use, the cleaning formulations of the present invention are stored in a receptacle, for example, a bucket, for application by an applicator. In a particularly preferred embodiment, the cleaning formulations of the present invention are stored in a bucket and applied to a surface by a mop.

Trials:

Tests were carried out on the effectiveness of the formulations of the present invention, namely those detailed in Tables 1 and 2. The test results set out below relate to formulation D. The tests set out below with reference to formulation D were repeated on the other formulations, A1, A2, B1, B2, C1 and C2. These extra tests are not included for the purposes of brevity. However, the microbial tests, flocculation tests and stability tests carried out on A1, A2, B1, B2, C1 and C2 were very similar to the test results set out below.

Where appropriate, the tests were carried out using cleaning fluid held in buckets sold, for example, in the UK by Scot Young Research Ltd.

Microbial Tests

The formulations of the present invention were challenged at level to log 6 (1 million fold reduction) up to and including log 8 (100 million fold reduction), with test samples from:

(i) Used/contaminated water obtained from NHS hospitals after floor mopping.

(ii) A medical mop head cloth, after use.

Results confirmed kill effectiveness for 60 minutes, with diminishing kill effectiveness thereafter. Thus, the cleaning liquids of the present invention provide a cleaner environment to supplement routine disinfection at a reduced institutional cleaning cost.

In more detail, the tests were carried out by two independent microbiological test laboratories, namely, Thor Specialities (UK) Limited (Wincham, UK) and Panspermia Microbiology (Burnham-on-Crouch, UK).

A 1% solution of formulation D (20 g) (i.e. a solution of D in water with a mixing ratio of 1%) was made using a sample of used water from a hospital. The hospital water plus 1% solution of formulation D was challenged against different microbes (detailed below). Total viable counts of microbes were taken at 0, 15, 30 and 60 minutes.

The microbes tested were from available tissue cultures. NCIMB refers to British national collection of industrial and marine bacteria. NCTC refers to national collection of type cultures. ATCC refers to American type culture collection.

1. *Clostridium Difficile*: NCIMB 10666 (Spores & Vegetative Cells)

Challenge level: 8670000 cfu/ml (cfu refers to colony forming units, i.e. cfu is a count of the number of viable microorganisms introduced)

| Time in contact | Count | Recovery | % killed rate |
|---|---|---|---|
| 15 seconds | 45 | 0.000519% | 99.999% |
| 15 minutes | 10 | 0.001153% | 99.999% |
| 30 minutes | <10 | 0.001153% | 99.999% |
| 60 minutes | <10 | 0.001153% | 99.999% |

2. *Escherichia Coli* 0157:H7 NCIMB 13861

Challenge level: 750000 cfu/ml

| Time in contact | Count | Recovery | % killed rate |
|---|---|---|---|
| 15 seconds | 9050 | 1.2% | 98.80% |
| 15 minutes | 20 | 0.00267% | 99.997% |
| 30 minutes | 20 | 0.00267% | 99.997% |
| 60 minutes | 15 | 0.0002% | 99.998% |

3. Methicillin Resistant *Staphylococcus Aureus* NCTC 10442 (MRSA)

Challenge level: 6500000 cfu/ml

| Time in contact | Count | Recovery | % killed rate |
|---|---|---|---|
| 15 seconds | 162000 | 2.492% | 97.5077% |
| 15 minutes | 20 | 0.000308% | 99.9997% |
| 30 minutes | 2720 | 0.0418% | 99.958% |
| 60 minutes | <10 | 0.0001538% | 99.99985% |

4. *Pseudomonas Aeruginosa* ATCC 9027
Challenge level: 2800000 cfu/ml

| Time in contact | Count | Recovery | % killed rate |
|---|---|---|---|
| 15 seconds | <10 | 0.00035714% | 99.9996% |
| 15 minutes | <10 | 0.00035714% | 99.9996% |
| 30 minutes | <10 | 0.0035714% | 99.9996% |
| 60 minutes | <10 | 0.0035714% | 99.9996% |

5. *Staphylococcus Aureus* ATCC 6538
Challenge level: 2800000 cfu/ml

| Time in contact | Count | Recovery | % killed rate |
|---|---|---|---|
| 15 seconds | <10 | 0.00035714% | 99.9996% |
| 15 minutes | <10 | 0.00035714% | 99.9996% |
| 30 minutes | <10 | 0.0035714% | 99.9996% |
| 60 minutes | <10 | 0.0035714% | 99.9996% |

The formulations of the present invention have been found to be:

(i) Effective in reducing *Clostridium Difficile* NCIMB 10666 (spores & vegetative cells mix), in dirty & clean water, by 99.9999% (i.e. within the bounds of statistical error, no *Clostridium Difficile* remains).

(ii) Effective in reducing *Escherichia Coli* 0157:H7 NCIMB 13861 by 99.9999%.

(iii) Effective in reducing Methicillin resistant *Staphylococcus Aureus* NCTC 10442 by 99.9999%.

(iv) Effective in reducing *Pseudomonas Aeruginosa* ATCC 9027 and total viable counts by 99.999%

The strains of pathogens mentioned above, with respect to the activity of the formulations of the present invention, are commonly found in hospitals, and can cause a significant health risk to humans and animals.

Additional test results also showed that the formulations of the present invention, for example formulation D, are effective against pathogens for up to, including and for longer than 60 minutes after introduction of other, for example organic, matter into a 1% aqueous solution of formulation D. In other words, the formulations of the present invention are still active for a sustained period after the introduction of dirty matter, thus maximising the time between safe replenishment of cleaning formulation.

Flocculation Tests

Tests were carried out to simulate the effect of the formulations of the present invention on soiled water. Formulation D was specifically tested and the results of the tests on formulation D are shown below. Similar results were obtained for formulations A1, A2, B1, B2, C1 and C2, but are not detailed below for brevity. The resulting mixtures were analysed under an electron microscope.

A solution of soil was first prepared in a 50 ml beaker. 1-2 ml of the formulations of the present invention, in this example formulation D, were added to this solution. With a gentle shake, the solution formed agglomerates of dirt particles, with the precipitation of dense soil flocculants. Substantially clean water could be decanted, with substantially no soil particles present. Slides of agglomerates were prepared and allowed to dry at ambient temperature for 24 hrs. The slides were prepared with: (i) a solution of the cleaning liquid of the present invention; (ii) a solution of soil plus standard detergent (in this case, standard washing-up liquid) in water; and, (iii) a placebo of soiled solution in water.

After 24 hrs, the slides were analysed for agglomerates, under an electron microscope and the representations of FIGS. 1, 2 and 3 were obtained. The representations of FIGS. 1, 2 and 3 were obtained using an electron microscope at Bristol University (UK), with the following specification:

Instrument: Model Hitachi S=3500N
ESED: Signal Name
Data Size: 2360×1920
Magnification: 40
Accelerating Voltage: 1500 volt
Emission current: 42000 nA
Working Distance: 14900 um
Sub magnification: 40
Sub signal: ESED
Photo size: 1000
Operating: At 15 kV. Accelerating potential with an emission current of about 40 micro Amps. Operated in low vacuum mode with a chamber pressure of 50-100 Pascals (Pa) and working distance 15-10 mm. ESED are secondary electron images.

| | | | | |
|---|---|---|---|---|
| 1A. | Formulation D | 4ESED, 1 mm | WD 15.1 mm | 15 Kv |
| 1B. | Formulation D | 6ESED, 1 mm | WD 14.9 mm | 15 Kv |
| 2. | Detergent | 2ESED, 1 mm | WD 31.9 mm | 15 Kv |
| 3. | Control | 2ESED 1 mm | WD 14.9 mm | 15 Kv |

Figure 1A:
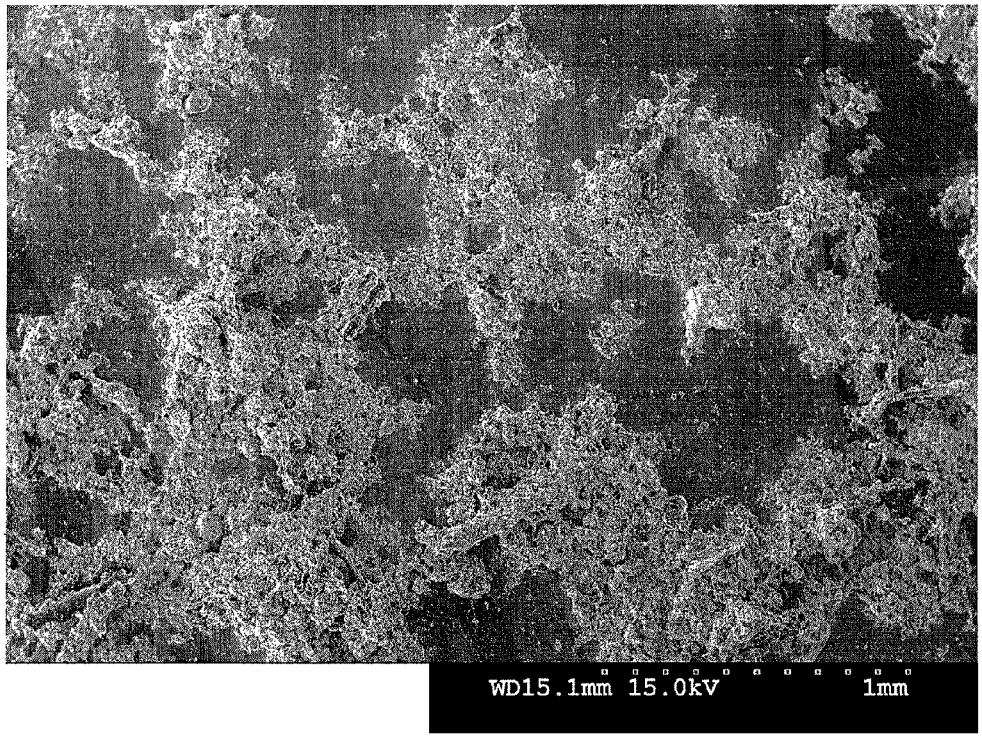
FIGS. 1A and 1B show flocculation of soil particles in a solution of the cleaning liquid of the present invention.
Figure 1B:
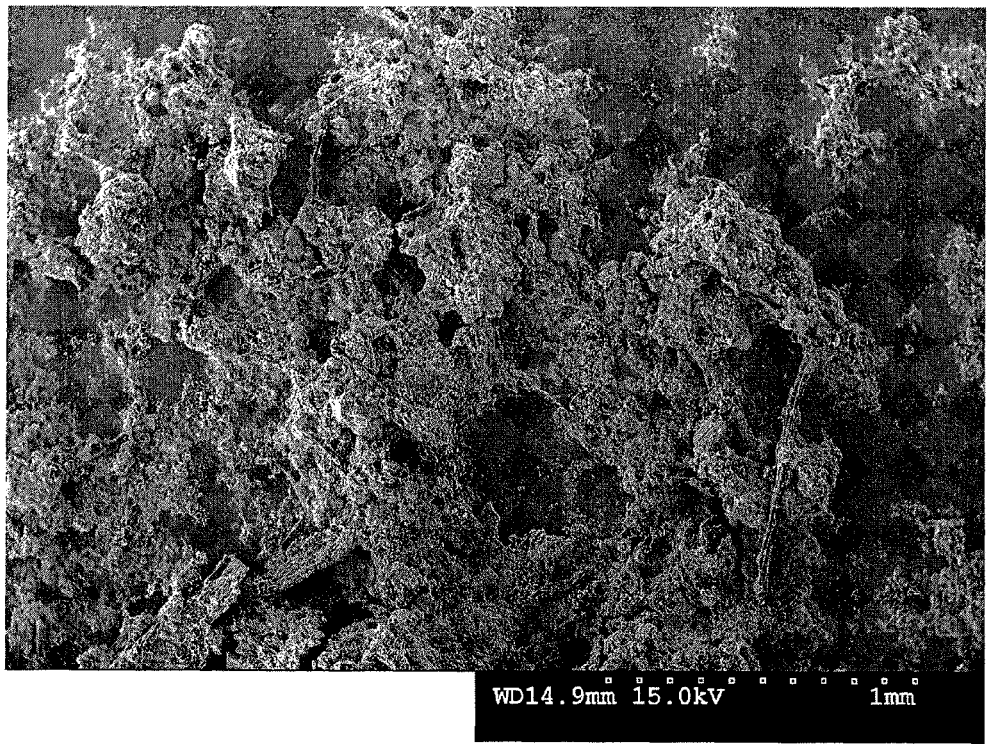
Figure 2:
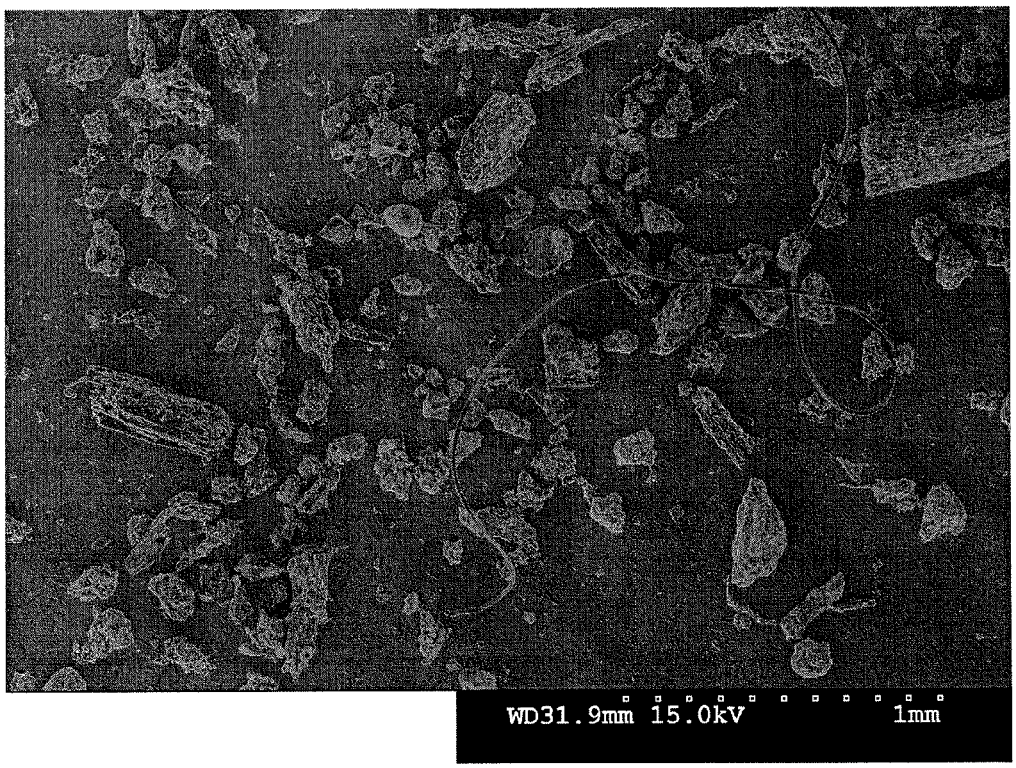
FIG. 2 shows a solution of soil plus standard detergent in water, where the detergent has spread the soil particles over a wider surface area without cleaning the water.
Figure 3:
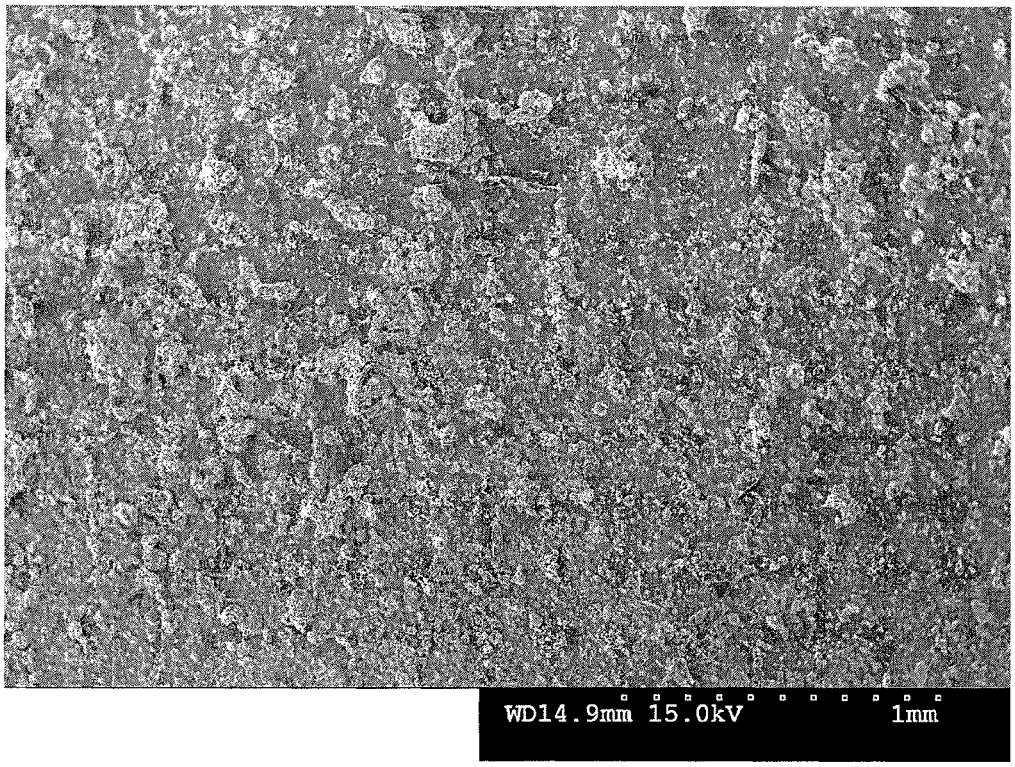
FIG. 3 shows a control of soil in water, where the soil particles are spread out throughout the solution.

Comparison of FIGS. 1A, 1B, 2 and 3 results shows separation of soil in the form of agglomerates when using the cleaning liquids of the present invention. Using standard detergent solution, or plain water, the soil particles float in solution and do not agglomerate. During rinsing they are expected to re-spread over wider area compared to with use of the cleaning solutions of the present invention where dense agglomerates of soil particles separate easily.

Stability

The stability of the formulations of the present inventions was tested. A batch of formulation D, from Table 2, was prepared. Five 200 g batches of formulation D were placed in identical separate sealed HDPE bottles. The five bottles were each placed in different environments. The first bottle was placed in the dark at room temperature, the second bottle was placed in the dark at 30° C., the third bottle was placed in the dark at 40° C., the fourth bottle was placed in the dark in the fridge at approximately 2.5° C. and the fifth bottle was placed under a standard bulb which was switched permanently on (in the light) at room temperature. Measurements were taken at the start of the time period and again at 2 week intervals up to 12 weeks.

The measurements showed that all of the formulations, under each condition:

- were still as active against pathogens as at the start of the testing;
- maintained a two-phase consistency;
- remained opaque in appearance;
- remained lump free;
- maintained a pink colour;
- maintained a viscosity of 150-200 cps;
- maintained a refractive index of 24;
- maintained a pH of 0.5 to 1.2;

formed flocculants when in contact with soil in water.

In the above, the viscosity value was measured on a Brookfield Model RVT Spindle 3 at 20 revs/min. The viscosity value recorded is a measure of the resistance of liquid to change of shape; often it is defined as a resistance to flow of fluid. It is measured in units of poises (dyne in seconds per square cm.) or a subdivision of poises. The units of cps given above refer to centipoise, one centipoise is a 1/100th of a poise, symbolized as cp or cps. It is the amount of force necessary to move a layer of liquid in relation to another liquid. Centipoise is considered a standard unit of measurement for fluids of all types.

In the above, the refractive index was measured using a Leica IFT40, Industrial Fluid Tester 7540, Automatically Temperature Compensated. This instrument measures refraction of light scattered through a prism with interference of solids in the solution being tested. Refractive index is a constant for a given mixture of materials. It is defined as a constant arising from Snell's Law. In other words, the refractive index is the refraction of light passing from air through a prism when an incident light scatters within the prism relative to solids in solution present. A constant reading is for the effect for refraction of light that is bending of light waves as they pass from one substance into another. The formulations of the present invention were found to have constant numbers for their refractive indices over the time period tested. This test shows that the solid content in the tested samples remains more or less constant, indicating no breakdown of the formulations.

The results of the stability tests show that the formulations of the present invention are stable, and maintain their desirable properties under different conditions and over a period of time. This indicates that the formulations of the present invention are suitably stable for general use.

Other known formulations are less stable than the formulations of the present invention in that they generally degrade. Degradation is shown, for example, by changes in refractive index over time. Cleaning liquids which contain chlorine based anti-pathogen agents are generally unstable and degrade over time.

As can be seen from the above results, it is clear that a product in accordance with the present invention is able to act as a cleaning liquid which has beneficial properties.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

TABLE 1

| | | Formulations: Ingredient amounts in % w/w | | | |
|---|---|---|---|---|---|
| Ingredient | CAS No. | A | B | C | Function |
| Water | N/A | to 100 | to 100 | to 100 | Diluent |
| Monohydrate citric acid | 5949-29-1 | 10-15 | 10-20 | 10-17.5 | pH adjuster |
| Non-ionic surfactant | 68439-45-2 | 12-16 | 12-16 | 12-16 | Surfactant |
| Alkyl poly glucoside | 68515-73-1 | 5-10 | 5-10 | 5-10 | Surfactant |
| Ethanium, N,N,N-trimethyl-2-((2-methyl-1-oxo-2-propenyl)) chloride, polymer with 2-propenamide | 35429-19-7 | 0.9-1.25 | 1.0-1.65 | 1.0-2.0 | Flocculant |
| Paraffin oil | 8042-47-5 | 0.5-0.75 | 0.54-0.75 | 0.25-0.75 | Flocculant |
| Alkyl Polyglycol ether C12-15 with EO | 68551-13-3 | 0.1-0.2 | 0.17-0.3 | 0.18-0.6 | Solubiliser |
| Disodium EDTA | 6381-92-6 | 0.05-0.20 | 0.05-0.20 | 0.05-0.20 | Chelating agent |
| Isothiazolinones mixture | 55965-84-9 | 0.02-0.10 | 0.02-0.10 | 0.02-0.10 | Preservative |
| Butyl Glycol | 111-76-2 | 5-15 | 5-15 | 5-15 | Solvent |
| 2-Bromo-2-nitro-1,3-propanediol | 52-51-7 | 0.45-1.3 | 0.52-1.3 | 0.6-1.5 | Anti-bacterial (Gram +ve and −ve), anti-fungal, anti-mould, anti-yeast |
| Glutaral | 111-30-8 | 0.1-0.5 | 0.1-1.0 | 0.1-1.0 | Anti-bacterial (Gram +ve and −ve), anti-fungal |
| Poly (hexamethylenebiguanidine) hydrochloride | 27083-27-8 | 0.8-3.0 | 0.9-3.7 | 1.0-5.0 | Anti-bacterial, anti-fungal, anti-mould, anti-yeast |
| Di-n-decyl dimethylammonium Chloride | 7173-51-5 | 5.0-9.5 | 8.5-9.5 | 6.0-9.0 | Anti-bacterial, anti-fungal, anti-mould, anti-yeast |
| Propan-2-ol | 67-63-0 | 5.0-9.5 | 8.5-9.5 | 6.0-9.0 | Solvent |
| Phosphoric acid | 7664-38-2 | 4.0-8.5 | 4.0-8.5 | 4.0-8.5 | pH adjuster |
| Floral Bouquet 245567 | Proprietary | 0.2-0.4 | 0.2-0.40 | 0.2-0.40 | Fragrance |
| Acid Red 14 Conc 160% | 3567-69-9/13613-55-3 | 0.000340 | 0.000340 | 0.000340 | Colour |
| Acid Blue 9/33% 42090 | 384-45-9 | 0.00043333 | 0.00043333 | 0.00043333 | Colour |

Properties common to each of formulation A, B and C:

Appearance: 2 phase products; blend easily with a gentle shake

Colour: Pink, Pentone code 1905U-1951U

Odour: Floral pH at 20° C.: 0.5-1.2

Refractive index: >24

Viscosity; Brookfield Model RVF, Spindle 3, Speed 20: 25-100 cps

TABLE 2

| Ingredient | CAS No. | Formulations: Ingredient amounts in % w/w | | | | | | |
|---|---|---|---|---|---|---|---|---|
| | | A1 | A2 | B1 | B2 | C1 | C2 | D |
| Water | N/A | to 100 | to 100 | to 100 | to 100 | to 100 | to 100 | to 100 |
| Monohydrate citric acid | 5949-29-1 | 10 | 15 | 15 | 20 | 12.5 | 17.5 | 10 |
| Non-ionic surfactant | 68439-45-2 | 12 | 16 | 12 | 16 | 12 | 16 | 14 |
| Alkyl poly glucoside | 68515-73-1 | 7 | 10 | 7 | 10 | 7 | 10 | 5 |
| Ethanium, N,N,N-trimethyl-2-((2-methyl-1-oxo-2-propenyl)) chloride, polymer with 2-propenamide | 35429-19-7 | 0.9 | 1.1 | 1.0 | 1.65 | 1.0 | 2.0 | 1.25 |
| Paraffin oil | 8042-47-5 | 0.5 | 0.6 | 0.54 | 0.75 | 0.25 | 0.4 | 0.75 |
| Alkyl Polyglycol ether C12-15 with EO | 68551-13-3 | 0.1 | 0.2 | 0.17 | 0.3 | 0.3 | 0.6 | 0.19 |
| Disodium EDTA | 6381-92-6 | 0.05 | 0.20 | 0.05 | 0.20 | 0.05 | 0.20 | 0.05 |
| Isothiazolinones mixture | 55965-84-9 | 0.02 | 0.10 | 0.02 | 0.10 | 0.02 | 0.10 | 0.1 |
| Butyl Glycol | 111-76-2 | 10 | 10 | 10 | 10 | 10 | 10 | 10 |
| 2-Bromo-2-nitro-1,3-propanediol | 52-51-7 | 0.45 | 0.9 | 0.52 | 1.2 | 0.6 | 1.5 | 1.3 |
| Glutaral | 111-30-8 | 0.1 | 0.5 | 0.1 | 1.0 | 0.1 | 1.0 | 0.5 |
| Poly (hexamethylenebiguanidine) hydrochloride | 27083-27-8 | 0.8 | 2.4 | 0.9 | 3.7 | 1.0 | 5.0 | 3 |
| Di-n-decyl dimethylammonium Chloride | 7173-51-5 | 5.0 | 9.5 | 8.5 | 9.5 | 6.0 | 9.0 | 9 |
| Propan-2-ol | 67-63-0 | 5.0 | 9.5 | 8.5 | 9.5 | 6.0 | 9.0 | 9 |
| Phosphoric acid | 7664-38-2 | 4.0 | 8.5 | 4.0 | 8.5 | 4.0 | 8.5 | 4.25 |
| Floral Bouquet 245567 | Proprietary | 0.2 | 0.4 | 0.2 | 0.40 | 0.2 | 0.40 | 0.2 |
| Acid Red 14 Conc 160% | 3567-69-9/13613-55-3 | 0.000340 | 0.000340 | 0.000340 | 0.000340 | 0.000340 | 0.000340 | 0.000340 |
| Acid Blue 9/33% 42090 | 384-45-9 | 0.00043333 | 0.00043333 | 0.00043333 | 0.00043333 | 0.00043333 | 0.00043333 | 0.00043333 |

The invention claimed is:

1. A cleaning liquid comprising:

a surfactant, wherein the surfactant comprises 12-16% w/w of non-ionic surfactant C9-C11-Pareth-8 and 5-10% w/w of alkyl polyglucoside, a flocculant, an anti-pathogenic agent, wherein the anti-pathogenic agent comprises 0.45-1.5% w/w of 2-bromo-2-nitro-1,3-propanediol, 0.1-1.0% w/w of glutaral, 0.8-5.0% w/w of poly (hexamethylenebiguanidine)hydrochloride and 5.0-9.5% w/w of di-n-decyl dimethylammonium chloride, and an acid, wherein the acid comprises 10-20% w/w of monohydrate citric acid and 4-8.5% w/w of phosphoric acid, wherein, the acid maintains the cleaning liquid at a pH of 0.5 to 1.2 at 20° C.

2. The cleaning liquid of claim 1, wherein the flocculant is N,N,N-trimethyl-2-(2-methyl-1-oxo-2-propenyl)chloride, polymer with 2-propenamide and/or paraffin oil.

3. The cleaning liquid of claim 2, wherein the mixture comprises 0.9-2.0% w/w of N,N,N-trimethyl-2-(2-methyl-1-oxo-2-propenyl)chloride, polymer with 2-propenamide and 0.25-0.75 w/w of paraffin oil.

4. The cleaning liquid of claim 1, wherein the anti-pathogenic agent is an anti-bacterial, an anti-fungal, an anti-mould, an anti-yeast and/or an anti-viral agent.

5. The cleaning liquid of claim 1, wherein the cleaning liquid further comprises a solubiliser which is alkyl polyglycol ether C12-15 with EO.

6. The cleaning liquid of claim 5, wherein the cleaning liquid comprises 0.1-0.6% w/w of alkyl polyglycol ether C12-15 with EO.

7. The cleaning liquid of claim 1, wherein the cleaning liquid further comprises a chelating agent which is disodium EDTA.

8. The cleaning liquid of claim 7, wherein the cleaning liquid comprises 0.05-0.20% w/w of disodium EDTA.

9. The cleaning liquid of claim 1, the cleaning liquid further comprising a preservative which is an isothiazolinones mixture.

10. The cleaning liquid of claim 9, wherein the cleaning liquid comprises 0.02-0.10% w/w of isothiazolinones mixture.

11. The cleaning liquid of claim 1, the cleaning liquid further comprising a fragrance.

12. The cleaning liquid of claim 1, the cleaning liquid further comprising a colourant.

13. The cleaning liquid of claim 1, the cleaning liquid further comprising a solvent selected from the group consisting of butyl glycol and propan-2-ol.

14. An aqueous mixture comprising: water and a cleaning liquid, wherein the cleaning liquid comprises:

a surfactant, wherein the surfactant comprises 12-16% w/w of non-ionic surfactant C9-C11-Pareth-8 and 5-10 w/w of alkyl polyglucoside, a flocculant, an anti-pathogenic agent, wherein the anti-pathogenic agent comprises 0.45-1.5 w/w of 2-bromo-2-nitro-1,3-propanediol, 0.1-1.0% w/w of glutaral, 0.8-5.0 w/w of poly (hexamethylenebiguanidine)hydrochloride and 5.0-9.5% w/w of di-n-decyl dimethylammonium chloride, and an acid, wherein the acid comprises 10-20% w/w of monohydrate citric acid and 4-8.5% w/w of phosphoric acid, and wherein, the acid maintains the cleaning liquid at a pH of 0.5 to 1.2 at 20° C.

15. The aqueous mixture of claim 14, wherein the water is tap water, potable water, dirty water, water containing soil, water containing effluent, water containing pathogens, water containing waste, waste water and/or brackish water.

16. The aqueous mixture of claim 14, wherein the formulation has a ratio of water to cleaning liquid of from 99% water to 1% cleaning liquid to 1% water to 99% cleaning liquid.

17. The aqueous mixture of claim 16, wherein the formulation has a ratio of water to cleaning liquid of 99%, 95%, 90%, 85%, 80%, 75%, 70%, 65%, 60%, 55%, 50%, 45%, 40%, 35%, 30%, 25%, 20%, 15%, 10%, 5%, 4%, 3%, 2%, 1.5%, 1%, 0.9%, 0.8%, 0.7%, 0.6%, 0.5%, 0.4%, 0.3%, 0.2%, 0.1% or 0.05% water to cleaning liquid.

18. The aqueous mixture of claim 14, wherein the formulation has a ratio of water to cleaning liquid of from 99% water to 1% cleaning liquid.

19. A method of cleaning a surface, comprising:

providing a cleaning liquid comprising: a surfactant, wherein the surfactant comprises 12-16% w/w of non-ionic surfactant C9-C11-Pareth-8 and 5-10% w/w of alkyl polyglucoside, a flocculant, an anti-pathogenic agent, wherein the anti-pathogenic agent comprises 0.45-1.5% w/w of 2-bromo-2-nitro-1,3-propanediol, 0.1-1.0% w/w of glutaral, 0.8-5.0% w/w of poly (hexamethylenebiguanidine)hydrochloride and 5.0-9.5% w/w of di-n-decyl dimethylammonium chloride, and an acid, wherein the acid comprises 10-20% w/w of monohydrate citric acid and 4-8.5% w/w of phosphoric acid, and wherein, the acid maintains the cleaning liquid at a pH of 0.5 to 1.2 at 20° C.; and, applying the mixture to a surface.

20. A method of cleaning a surface, comprising:

providing an aqueous mixture comprising: water and a cleaning liquid, wherein the cleaning liquid comprises: a surfactant, wherein the surfactant comprises 12-16% w/w of non-ionic surfactant C9-C11-Pareth-8 and 5-10% w/w of alkyl polyglucoside, a flocculant, an anti-pathogenic agent, wherein the anti-pathogenic agent comprises 0.45-1.5% w/w of 2-bromo-2-nitro-1,3-propanediol, 0.1-1.0% w/w of glutaral, 0.8-5.0 w/w of poly (hexamethylenebiguanidine)hydrochloride and 5.0-9.5 w/w of di-n-decyl dimethylammonium chloride, and an acid, wherein the acid comprises 10-20% w/w of monohydrate citric acid and 4-8.5% w/w of phosphoric acid, and wherein, the acid maintains the cleaning liquid at a pH of 0.5 to 1.2 at 20° C.; and, applying the mixture to a surface.

21. A method of preparing a cleaning liquid comprising: a surfactant, wherein the surfactant comprises 12-16% w/w of non-ionic surfactant C9-C11-Pareth-8 and 5-10 w/w of alkyl polyglucoside, a flocculant, an anti-pathogenic agent, wherein the anti-pathogenic agent comprises 0.45-1.5% w/w of 2-bromo-2-nitro-1,3-propanediol, 0.1-1.0% w/w of glutaral, 0.8-5.0 w/w of poly (hexamethylenebiguanidine)hydrochloride and 5.0-9.5% w/w of di-n-decyl dimethylammonium chloride, and an acid, wherein the acid comprises 10-20% w/w of monohydrate citric acid and 4-8.5% w/w of phosphoric acid, and wherein, the acid maintains the cleaning liquid at a pH of 0.5 to 1.2 at 20° C., the method comprising:

providing the ingredients; and, mixing the ingredients in a mixer.

22. A cleaning liquid with the formulation of any one of formulations, wherein ingredient amounts are in (% w/w)

A: water (to 100); monohydrate citric acid (10-15); non-ionic surfactant (12-16); alkyl poly glucoside (5-10); N,N,N-trimethyl-2-((2-methyl-1-oxo-2-propenyl)) chloride, polymer with 2-propenamide (0.9-1.25); paraffin oil (0.5-0.75); alkyl polyglycol ether C12-15 with EO (0.1-0.2); disodium EDTA (0.05-0.20); isothiazolinones mixture (0.02-0.10); butyl glycol (5-15); 2-Bromo-2-nitro-1,3-propanediol (0.45-1.3); glutaral (0.1-0.5); poly (hexamethylenebiguanidine)hydrochloride (0.8-3.0); Di-n-decyl dimethylammonium Chloride (5.0-9.5); propan-2-ol (5.0-9.5); phosphoric acid (4.0-8.5); fragrance (0.2-0.4) and color (0.00077333), B: water (to 100); monohydrate citric acid (10-20); non-ionic surfactant (12-16); alkyl poly glucoside (5-10); N,N,N-trimethyl-2-((2-methyl-1-oxo-2-propenyl)) chloride, polymer with 2-propenamide (1.0-1.65); paraffin oil (0.54-0.75); alkyl polyglycol ether C12-15 with EO (0.17-0.3); disodium EDTA (0.05-0.20); isothiazolinones mixture (0.02-0.10); butyl glycol (5-15); 2-Bromo-2-nitro-1,3-propanediol (0.52-1.3); glutaral (0.1-1.0); poly hexamethylenebiguanidine)hydrochloride (0.9-3.7); Di-n-decyl dimethylammonium Chloride (8.5-9.5); propan-2-ol (8.5-9.5); phosphoric acid (4.0-8.5); fragrance (0.2-0.4) and color (0.00077333), C: water (to 100); monohydrate citric acid (10-17.5); non-ionic surfactant (12-16); alkyl poly glucoside (5-10); N,N,N-trimethyl-2-((2-methyl-1-oxo-2-propenyl)) chloride, polymer with 2-propenamide (1.0-2.0); paraffin oil (0.25-0.75); alkyl polyglycol ether C12-15 with EO (0.18-0.6); disodium EDTA (0.05-0.20); isothiazolinones mixture (0.02-0.10); butyl glycol (5-15); 2-Bromo-2-nitro-1,3-propanediol (0.6-1.5); glutaral (0.1-1.0); poly (hexamethylenebiguanidine)hydrochloride (1.0-5.0); Di-n-decyl dimethylammonium Chloride (6.0-9.0); propan-2-ol (6.0-9.0); phosphoric acid (4.0-8.5); fragrance (0.2-0.4) and color (0.00077333), A1: water (to 100); monohydrate citric acid (10); non-ionic surfactant (12); alkyl polyglucoside (7): N,N,N-trimethyl-2-((2-methyl-1-oxo-2-propenyl))chloride, polymer with 2-propenamide (0.9); paraffin oil (0.5); alkyl polyglycol ether C12-15 with EO (0.1); disodium EDTA (0.05); isothiazolinones mixture (0.02); butyl glycol (10); 2-Bromo-2-nitro-1,3-propanediol (0.45); glutaral (0.1); poly (hexamethylenebiguanidine)hydrochloride (0.8); Di-n-decyl dimethylammonium Chloride (5.0); propan-2-ol (5.0); phosphoric acid (4.0); fragrance (0.2) and color (0.00077333), A2: water (to 100); monohydrate citric acid (15); non-ionic surfactant (16); alkyl poly glucoside (10); N,N,N-trimethyl-2-((2-methyl-1-oxo-2-propenyl))chloride, polymer with 2-propenamide (1.1); paraffin oil (0.6); alkyl polyglycol ether C12-15 with EO (0.2); disodium EDTA (0.20); isothiazolinones mixture (0.10); butyl glycol (10); 2-Bromo-2-nitro-1,3-propanediol (0.9); glutaral (0.5); poly (hexamethylenebiguanidine)hydrochloride (2.4); Di-n-decyl dimethylammonium Chloride (9.5); propan-2-ol (9.5); phosphoric acid (8.5); fragrance (0.4) and color (0.00077333), B1: water (to 100); monohydrate citric acid (15); non-ionic surfactant (12); alkyl poly glucoside (7); N,N,N-trimethyl-2-((2-methyl-1-oxo-2-propenyl))chloride, polymer with 2-propenamide (1.0); paraffin oil (0.54); alkyl polyglycol ether C12-15 with EO (0.17); disodium EDTA (0.05); isothiazolinones mixture (0.02); butyl glycol (10); 2-Bromo-2-nitro-1,3-propanediol (0.52); glutaral (0.1); poly (hexamethylenebiguanidine)hydrochloride (0.9); Di-n-decyl dimethylammonium Chloride (8.5); propan-2-ol (8.5); phosphoric acid (4.0); fragrance (0.2) and color (0.00077333), B2: water (to 100); monohydrate citric acid (20); non-ionic surfactant (16); alkyl poly glucoside (10); N,N,N-trimethyl-2-((2-methyl-1-oxo-2-propenyl))chloride, polymer with 2-propenamide (1.65); paraffin oil (0.75); alkyl polyglycol ether C12-15 with EO (0.3); disodium EDTA (0.20); isothiazolinones mixture (0.10); butyl glycol (10); 2-Bromo-2-nitro-1,3-propanediol (1.2); glutaral (1.0); poly (hexamethylenebiguanidine)hydrochloride (3.7); Di-n-decyl dimethylammonium Chloride (9.5); propan-2-ol (9.5); phosphoric acid (8.5); fragrance (0.4) and color (0.00077333), C1: water (to 100); monohydrate citric acid (12.5); non-ionic surfactant (12); alkyl poly glucoside (7); N,N,N-trimethyl-2-((2-methyl-1-oxo-2-propenyl))chloride, polymer with 2-propenamide (1.0); paraffin oil (0.25); alkyl polyglycol ether C12-15 with EO (0.3); disodium EDTA (0.05); isothiazolinones mixture (0.02); butyl glycol (10); 2-Bromo-2-nitro-1,3-propanediol (0.6); glutaral (0.1); poly (hexamethylenebiguanidine)hydrochloride (1.0); Di-n-decyl dimethylammonium Chloride (6.0); propan-2-ol (6.0); phosphoric acid (4.0); fragrance (0.2) and color (0.00077333), C2: water (to 100); monohydrate citric acid (17.5); non-ionic surfactant (16); alkyl poly glucoside (10); N,N,N-trimethyl-2-((2-methyl-1-oxo-2-propenyl))chloride, polymer with 2-propenamide (2.0); paraffin oil (0.4); alkyl polyglycol ether C12-15 with EO (0.6); disodium EDTA (0.20); isothiazolinones mixture (0.10); butyl glycol (10); 2-Bromo-2-nitro-1,3-propanediol (1.5); glutaral (1.0); poly (hexamethylenebiguanidine)hydrochloride (5.0); Di-n-decyl dimethylammonium Chloride (9.0); propan-2-ol (9.0); phosphoric acid (8.5); fragrance (0.4) and color (0.00077333), or D: water (to 100); monohydrate citric acid (10); non-ionic surfactant (14); alkyl poly glucoside (5); N,N,N-trimethyl-2-((2-methyl-1-oxo-2-propenyl))chloride, polymer with 2-propenamide (1.25); paraffin oil (0.75); alkyl polyglycol ether C12-15 with EO (0.19); disodium EDTA (0.05); isothiazolinones mixture (0.1); butyl glycol (10); 2-Bromo-2-nitro-1,3-propanediol (1.3); glutaral (0.5); poly (hexamethylenebiguanidine)hydrochloride (3); Di-n-decyl dimethylammonium Chloride (9); propan-2-ol (9); phosphoric acid (4.25); fragrance (0.2) and color (0.00077333).

* * * * *